US010883262B2

(12) United States Patent
Han

(10) Patent No.: US 10,883,262 B2
(45) Date of Patent: Jan. 5, 2021

(54) OVERFLOW CHAMBER FOR EMISSION OF RAINWATER AND SOIL

(71) Applicant: Byungsook Han, Chungcheongbuk-do (KR)

(72) Inventor: Byungsook Han, Chungcheongbuk-do (KR)

( * ) Notice: Subject to any disclaimer, the term of this patent is extended or adjusted under 35 U.S.C. 154(b) by 0 days.

(21) Appl. No.: 14/888,573

(22) PCT Filed: May 7, 2014

(86) PCT No.: PCT/KR2014/003985
§ 371 (c)(1),
(2) Date: Nov. 2, 2015

(87) PCT Pub. No.: WO2014/182029
PCT Pub. Date: Nov. 13, 2014

(65) Prior Publication Data

US 2016/0083951 A1 Mar. 24, 2016

(30) Foreign Application Priority Data

May 6, 2013 (KR) ..... 10-2013-0050511

(51) Int. Cl.
*E03F 5/10* (2006.01)

(52) U.S. Cl.
CPC ..... *E03F 5/107* (2013.01)

(58) Field of Classification Search
CPC ..... Y10T 137/87877; Y10T 137/2774; Y10T 137/2842; Y10T 137/2795; Y10T 137/3006; Y10T 137/3009; Y10T 137/7365; Y10T 137/2768; Y10T 137/2761; Y10T 137/86252; Y10T 137/7439; E02B 7/18; E03F 5/107; F16K 3/0281; F16K 3/0254
See application file for complete search history.

(56) References Cited

U.S. PATENT DOCUMENTS 301,391 A * 7/1884 Reinecke ..... E03D 1/165 137/135
1,770,340 A * 7/1930 Lawaczeck ..... E02B 7/18 405/108

(Continued)

FOREIGN PATENT DOCUMENTS

JP 09-228429 9/1997 ..... E03B 3/02
KR 10-0684923 2/2007 ..... E03F 5/14

(Continued)

OTHER PUBLICATIONS

International Search Report (ISR) dated Sep. 26, 2014 in PCT/KR2014/003985.

*Primary Examiner* — Matthew W Jellett
(74) *Attorney, Agent, or Firm* — Harness, Dickey & Pierce, P.L.C.

(57) ABSTRACT

A overflow chamber that can discharge rainwater and soil according to the present disclosure includes: a receiving unit having a receiving space; an interceptor port formed at a side of the receiving unit and selectively opening/closing in accordance with the amount of received object received in the receiving unit; a discharge port formed at another side of the receiving unit; and a first discharge pipe communicating with the discharge port and convexly bending upward at least one time.

12 Claims, 4 Drawing Sheets

(56) References Cited

U.S. PATENT DOCUMENTS

| | | | | | |
|---|---|---|---|---|---|
| 2,062,390 | A * | 12/1936 | Brown | E03F 5/107 | 137/409 |
| 2,150,359 | A * | 3/1939 | Brown | E03F 5/107 | 137/115.02 |
| 3,575,004 | A * | 4/1971 | Gachne | E02B 7/18 | 137/132 |
| 3,822,715 | A * | 7/1974 | Rao | E02B 13/02 | 137/135 |
| 4,291,836 | A * | 9/1981 | Chen-Hsiung | A01G 27/001 | 137/132 |
| 4,318,421 | A * | 3/1982 | Ward | E04H 4/10 | 137/135 |
| 4,545,403 | A * | 10/1985 | Vischer | G05D 7/0113 | 137/395 |
| 4,865,070 | A * | 9/1989 | Delwiche | F16K 31/22 | 137/172 |
| 4,896,800 | A * | 1/1990 | Corey | F04F 10/00 | 222/416 |
| 5,348,041 | A * | 9/1994 | Clark | B01D 17/0208 | 137/172 |
| 5,707,527 | A * | 1/1998 | Knutson | B01D 29/15 | 210/170.03 |
| 5,725,011 | A * | 3/1998 | Hermensson | B01D 17/0208 | 137/172 |
| 8,425,150 | B1 * | 4/2013 | Happel | E02B 7/28 | 251/326 |

FOREIGN PATENT DOCUMENTS

| | | | |
|---|---|---|---|
| KR | 10-0986644 | 10/2010 | E03F 5/14 |
| KR | 10-2011-0094778 | 8/2011 | E03F 5/14 |

* cited by examiner

OVERFLOW CHAMBER FOR EMISSION OF RAINWATER AND SOIL

CROSS-REFERENCE TO RELATED APPLICATIONS

This application is a national phase application of PCT Application No. PCT/KR2014/003985, filed on 7 May 2014, which claims benefit of Korean Patent Application 10-2013-0050511, filed on 6 May 2013. The entire disclosure of the applications identified in this paragraph are incorporated herein by reference.

FIELD

The present disclosure relates to an overflow chamber for emission of rainwater and soil, particularly, an overflow chamber for emission of rainwater and soil that can significantly reduce sewage treatment cost by preventing rainwater and soil from flowing into a sewage treatment plant, using a siphon principle and buoyancy and that controls separate discharge of rainwater and sewage.

BACKGROUND

This section provides background information related to the present disclosure which is not necessarily prior art.

In general, a sewage treatment system is classified into a combined sewage treatment system that discharges sewage and rainwater flowing inside through the same sewage pipe and a separate sewage treatment system that discharges rainwater and sewage through separate sewage pipes and rainwater pipes.

In relation to these systems, a "Sewage in-draft control device having storm overflow chamber" has been disclosed in Korean Patent No. 0774588.

Sewerages in large cities are most configured in a combined sewage treatment system, in which sewage and rainwater flow through one sewage pipe and an overflow chamber is disposed at a joint of an interceptor channel.

Meanwhile, according to a sewerage facility standard established by Environment department, three times the maximum amount of sewage per day is considered as sewage when it rains, and the sewage diluted three times or more can be discharged to a river or a lake.

Accordingly, the amount of rain that can flow into a sewerage treatment plate through an interceptor channel is regulated three times the maximum amount of sewage per day, and even if sewage diluted three times or more of the maximum amount of sewage per day when it rains is blocked by an overflow chamber, it does not violate the facility standard.

On the other hand, sewerage treatment plants discharge sewage over a sewerage treatment capacity after precipitation when it rains, but when it rains, if the rainwater flowing into an interceptor channel from an overflow chamber is blocked, the sewerage treatment plants do not have to discharge.

Further, when it rains, a large amount of soil flows into a sewerage treatment plant due to high flow speed, but if there is a facility that can prevent soil from flowing from an overflow chamber into a sewerage treatment plant, it can help the operation of the sewerage treatment plant.

DISCLOSURE

Technical Problem

An object of the present disclosure is to provide an overflow chamber that can separately discharge rainwater and soil by installing two or more channels such as a discharge port and an interceptor port at the storage of an overflow chamber and by allowing for discharge through the discharge port only when the water level in the overflow chamber is over a predetermined height, using a siphon principle.

Another object of the present disclosure is to provide an overflow chamber that can separately discharge rainwater and soil and can reduce a sewerage treatment cost by preventing sewage and rainwater with low concentration that are not required to be treated from being discharged from a sewerage treatment plant by closing the inlet of an interceptor port when the water level in the storage of an overflow chamber increases, by connecting a device operated by buoyancy to the inlet of the interceptor port.

Technical Solution

This section provides a general summary of the disclosure and is not a comprehensive disclosure of its full scope or all of its features.

An overflow chamber that can discharge rainwater and soil according to one aspect of the present disclosure includes: a receiving unit having a receiving space; an interceptor port formed at a side of the receiving unit and selectively opening/closing in accordance with the amount of received object received in the receiving unit; a discharge port formed at another side of the receiving unit; and a first discharge pipe communicating with the discharge port and convexly bending upward at least one time.

In the overflow chamber that can discharge rainwater and soil according to one aspect of the present disclosure, the first discharge pipe may connect the discharge port to a river, become higher in discharge direction of the received object from an inlet of the discharge port and then become lower, and determine whether to discharge the received object flowing in the receiving unit on the basis of a siphon principle.

The overflow chamber that can discharge rainwater and soil according to one aspect of the present disclosure may further include a second discharge pipe connecting the interceptor port and a sewerage treatment plant.

The overflow chamber that can discharge rainwater and soil according to one aspect of the present disclosure may further include an opening/closing unit selectively opening/closing the interceptor port in accordance with buoyancy by the received object flowing in the receiving unit.

In the overflow chamber that can discharge rainwater and soil according to one aspect of the present disclosure, when the level of the received object flowing in the receiving unit is lower than a predetermined level, the received object may be discharged through the interceptor port that is open, not to the first discharge pipe.

In the overflow chamber that can discharge rainwater and soil according to one aspect of the present disclosure, when the level of the received object flowing in the receiving unit is higher than a predetermined level, the received object may be discharged only to the first discharge pipe by a siphon principle, and the interceptor port may be closed.

In the overflow chamber that can discharge rainwater and soil according to one aspect of the present disclosure, the opening/closing unit may include: a cover plate covering and selectively opening/closing the interceptor port; and a floater being floated on the received object by buoyancy, vertically moving, and connected with the cover plate such that the cover plate is moved vertically with the floater vertically moving, in which when the floater is moved up in the receiving unit by buoyancy, the cover plate closes the interceptor port, and when the floater is moved down in the receiving unit, the cover plate opens the interceptor port.

In the overflow chamber that can discharge rainwater and soil according to one aspect of the present disclosure, the opening/closing unit may further include a holding member fixed at a predetermined position in the receiving unit; and a connecting member held on the holding member to be relatively moved and connecting the cover plate and the floater like a thread.

In the overflow chamber that can discharge rainwater and soil according to one aspect of the present disclosure, the floater may be made of a material heavier than the cover plate.

Accordingly, the inlet of the interceptor channel, that is, the interceptor port keeps open, not when it rains, but in a normal state.

In the overflow chamber that can discharge rainwater and soil according to one aspect of the present disclosure, the received object may be any one of sewage, rainwater, and soil or a mixture of two or more of them.

In the overflow chamber that can discharge rainwater and soil according to one aspect of the present disclosure, the received object may be sewage or rainwater with contamination degree higher than predetermined contamination concentration.

In the overflow chamber that can discharge rainwater and soil according to one aspect of the present disclosure, the received object may be sewage or rainwater with contamination degree lower than predetermined contamination concentration.

Advantageous Effects

According to the overflow chamber that can discharge rainwater and soil of the present disclosure, when a large amount of received object is in the receiving unit (that is, in heavy rain), the interceptor port connected to a sewerage treatment plant is closed, so the received object with relatively low contamination concentration (for example, sewage and rainwater) is prevented from flowing into the sewerage treatment plant and the sewerage treatment cost is reduced.

According to the overflow chamber that can discharge rainwater and soil of the present disclosure, when a small amount of received object is in the receiving unit (that is, it does not rain), the interceptor port connected to a sewerage treatment plant is opened, so received object with relatively high contamination concentration (for example, rainwater and soil) is allowed to flow into the sewerage treatment plant and is prevented from being discharged to a river through the discharge port by the siphon principle, so it is possible to prevent environment contamination due to discharged contaminant substances.

According to the overflow chamber that can discharge rainwater and soil of the present disclosure, the discharge port or the interceptor port can be accurately opened/closed in accordance with the amount of the received object by the first discharge pipe using the siphon principle and the opening/closing unit using buoyancy, so it is possible to prevent contaminants from being unexpectedly discharged to a river or non-contaminants from flowing into a sewerage treatment plant.

BEST MODE

The present disclosure will now be described in detail with reference to the accompanying drawing(s).

However, limited embodiments are exemplified to help clearly understand the spirit described below, but the present disclosure is not limited thereto and it should be noted that modifications that can be easily achieved by those skilled in the art from the spirit described in claims should be construed as being included in the embodiments described herein.

Further, terminologies used herein were selected for convenience of description by the inventor(s), so the meanings should be appropriately construed to meet the spirit of the present disclosure without being limited to the meanings in dictionaries.

Figure 1:
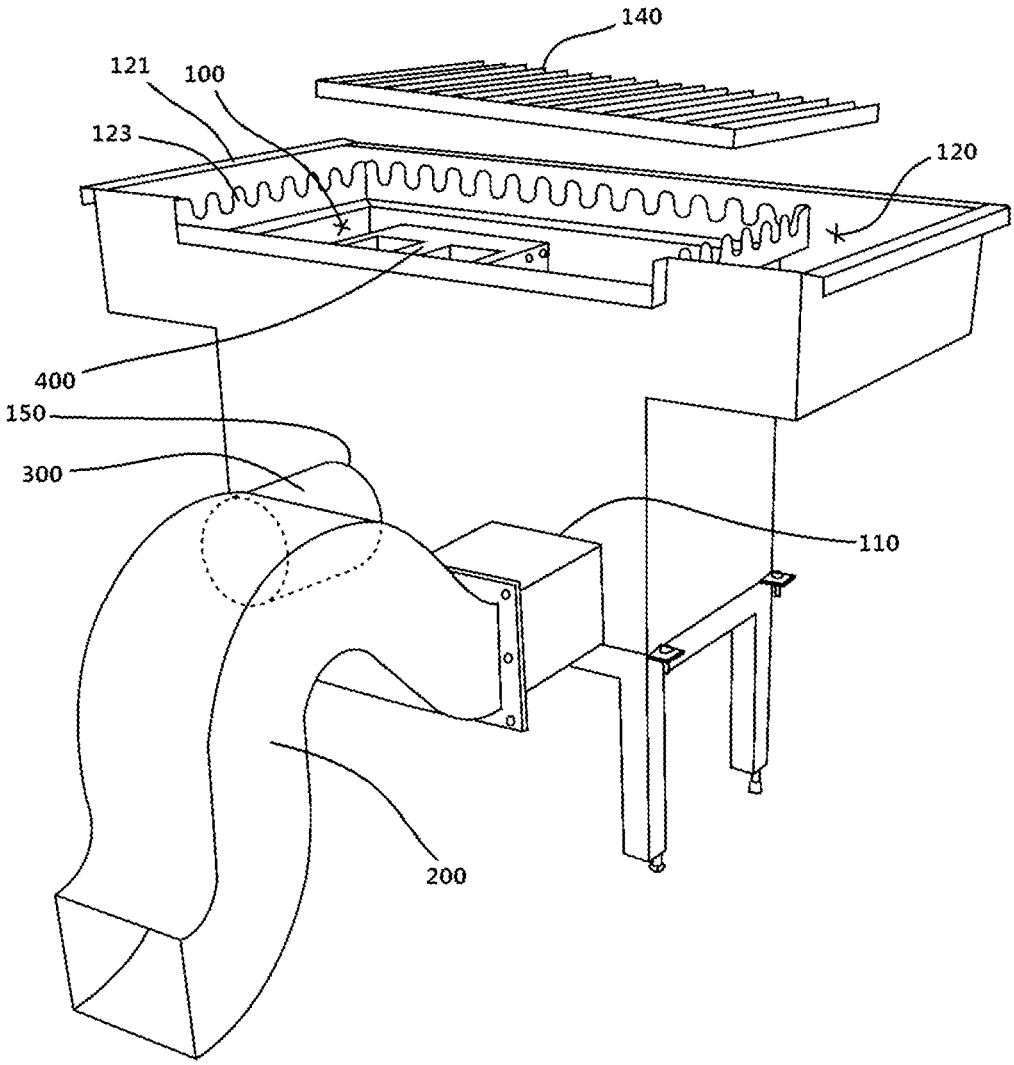
FIG. 1 is a view illustrating an overflow chamber that can discharge rainwater and soil according to an embodiment of the present invention.
Figure 2:
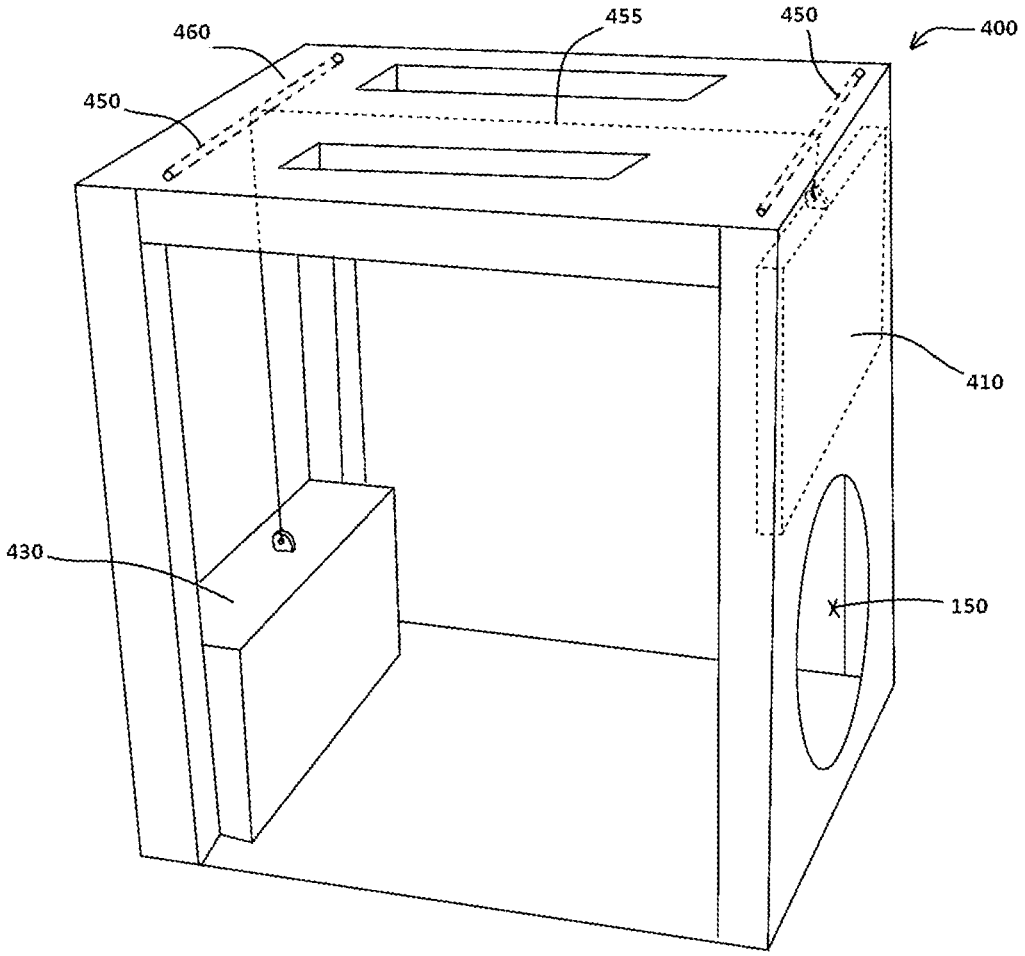
FIG. 2 is a view the opening/closing unit illustrated in FIG. 1.

FIG. 1 is a view illustrating an overflow chamber that can discharge rainwater and soil according to an embodiment of the present invention and FIG. 2 is a view the opening/closing unit illustrated in FIG. 1.

Referring to FIGS. 1 and 2, an overflow chamber that can discharge rainwater and soil according to an embodiment of the present invention includes a receiving unit 100, a first discharge pipe 200, a second discharge pipe 300, and an opening/closing unit 400.

The receiving unit 100 has a receiving space therein that can keep any one of sewage, rainwater, and soil or mixed liquid of two or more of them, and is not limited in shape, but may be formed in a rectangular parallelepiped shape with the top open in consideration of convenience of manufacturing and the manufacturing cost.

The receiving unit 100 may have a sub-receiving unit 120 around it which reduces the amount of received objects flowing into the receiving unit 100 by primarily keeping a received object that overflows in order to prevent the received object overflow outside when a large amount of received objects flow from the outside.

The outer wall 121 of the sub-receiving unit 120 may be lower than the inner wall 123 of the receiving unit 100 so that the received object kept in the sub-receiving unit 120 can be secondarily supplied back to the receiving unit 100.

A wave pattern is formed at the upper end of the inner wall 123 in FIG. 1 where some is at the height of the outer wall 121 of the receiving unit 120 and the other is lower than the outer wall 121 of the sub-receiving unit 120.

Meanwhile, a filtering net 140 for filtering impurities in received objects flowing into the receiving unit 100 from the outside may be further provided. Further, the filtering net 140 may be inclined so that the impurities filtered by the filtering net 140 can flow into the sub-receiving unit 120 by gravity.

The receiving unit 100 has a discharge port 110 and an interceptor port 150 formed through a side or the bottom of the receiving unit 100.

The discharge port 110 and the interceptor port 150 may be formed in parallel through a side of the receiving unit 100, as in FIG. 1. The shapes are not limited, to a circle and a polygon.

The interceptor port 150 may be formed in a circle at a lower portion of a side of the receiving unit 100 and the discharge port 110 may be formed to have a polygonal cross-section that is long in a transverse direction at a lower portion of the front side of the receiving unit 100. The discharge port 110 having a transversely oblong cross-section makes soil accumulated on the bottom of the receiving unit 100 be smoothly discharged.

The discharge port 110 and the interceptor port 150 may be formed through the bottom of the receiving unit 100.

The first discharge pipe 200 is connected to the discharge port 110 of the receiving unit 100 and is a pipe that communicates with a river and discharges rainwater with low concentration in the receiving unit 100 to the river.

The first discharge pipe 200 becomes higher toward the rear portion from the inlet of the discharge port 110 and then lower. That is, the first discharge pipe 200 becomes higher at a predetermined level from the inlet of the discharge port 110 and then becomes lower at the same level as the inlet of the discharge port 100, thereby making a substantially inverse U-shape. Preferably, the height of lower end of the first discharge pipe 200 may be the same as the height of the upper end of the interceptor port 150.

As described above, the first discharge pipe 200 becomes higher toward the rear portion from the discharge port 110 and then becomes lower, whether to discharge the sewage in the receiving unit 100 is determined in accordance with a change in water level in the receiving unit 100 by a siphon principle even without a specific opening/closing unit.

That is, when the water level in the receiving unit 100 is low in a normal state, the atmospheric pressure applied to the surface of the liquid in the receiving unit 100 is low, so the sewage in the receiving unit 100 is not discharged through the first discharge pipe 200, and when the water level in the receiving unit 100 increased due to rainwater from the outside when it rains, rainwater and soil with low concentration flowing in the receiving unit 100 are discharged through the first discharge pipe 200 by high atmospheric pressure applied to the surface of the liquid in the receiving unit 100.

Accordingly, even without a specific opening/closing unit, sewage flowing inside in a normal state is not discharged through the discharge port 110, but only when it rains and rainwater and soil with low concentration mixed in sewage flows into the receiving unit 100 and increase the water level in the receiving unit, the rainwater and soil with low concentration can be discharged to the first discharge pipe 200 through the discharge port 110.

The second discharge pipe 300 is connected to the interceptor port 150 of the receiving unit 100 and is a delivery pipe that communicates with an interceptor channel for delivering sewage and rainwater with high concentration to a sewerage treatment plant and blocks and sends sewage in the receiving unit 100 to the interceptor channel.

The opening/closing unit 400 is a unit for opening/closing the interceptor port 150 using buoyancy applied in the receiving unit 100 and may be implemented as in the following embodiments.

<First Embodiment of Opening/Closing Unit>

Figure 3:
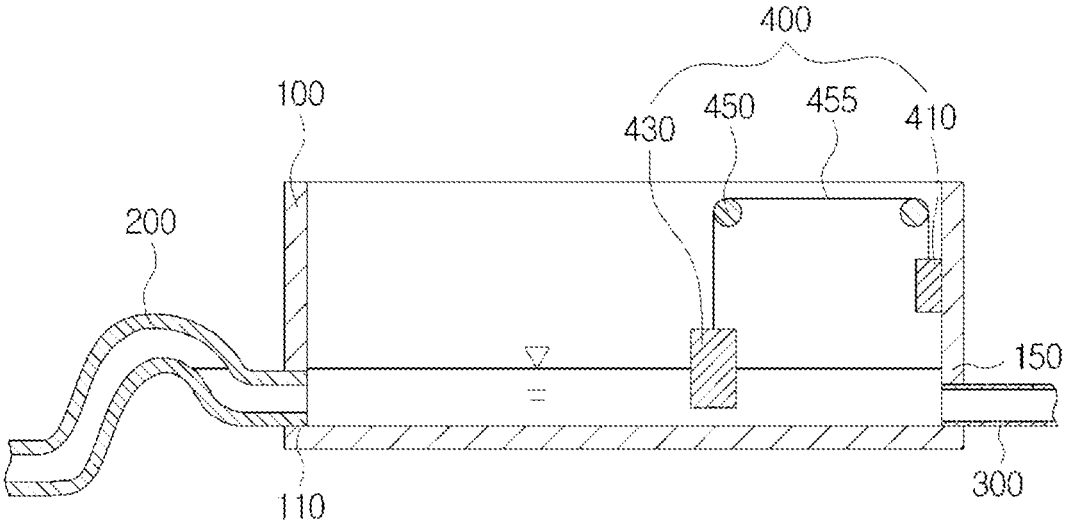
FIG. 3 is a view schematically illustrating an overflow chamber that can discharge rainwater and soil according to an embodiment of the present invention.
Figure 4:
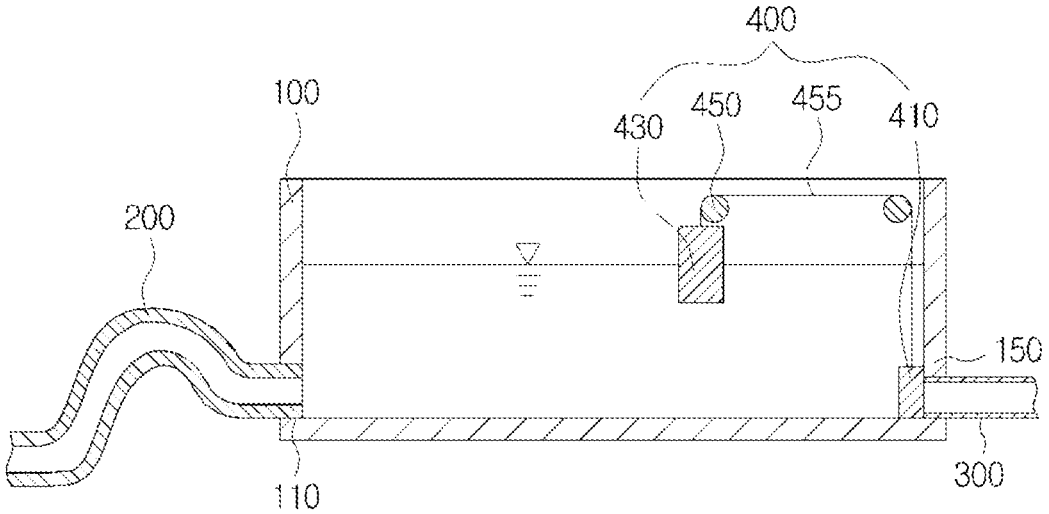
FIG. 4 is a view illustrating an example of operation of the overflow chamber illustrated in FIG. 3.

FIG. 3 is a view schematically illustrating an overflow chamber that can discharge rainwater and soil according to an embodiment of the present invention and FIG. 4 is a view illustrating an example of operation of the overflow chamber illustrated in FIG. 3.

Referring to FIGS. 3 and 4, the opening/closing unit 400 includes a cover plate 410, a floater 430, holding members 450, a connecting member 455, and has a frame 460 where these components are coupled.

The cover plate 410 can cover the interceptor port 150, and in this embodiment, the cover plate 410 is a circular plate, but it may be implemented in various shapes such as a rectangular plate as long as it can cover the entire interceptor port 150. Further, in this embodiment, the interceptor port 150 is formed through the front side of the receiving unit 100, the cover plate 410 can vertically move along the front side of the cover plate 410.

The floater 430 can be floated on water by buoyancy and can vertically move. In this embodiment, the floater 430 is disposed on a rear side facing the front side where the cover plate 410 is disposed and can vertically move.

Further, the floater 430 is connected to the cover plate 410 through the connecting member 455 to be described below.

The holding member 450 is fixed at predetermined positions in the receiving unit 100 and can hold the connecting member 455 to be described below.

In this embodiment, the holding members 450 are fixed at the uppermost portion of the receiving unit 100 and disposed over the floater 430 and the cover plate 410.

The holding members 450 may be a sheave or a pulley.

The connecting member 455 connects the cover plate 410 and the floater 450 like a thread and held by the holding members 450 to be freely moved. That is, the connecting member 455 with one end connected to the cover plate 410 is held and changed in direction by the holding member 450 over the cover plate 410 and then held and changed in direction by the holding member 450 over the floater 430, with the other connected to the floater 430.

When the floater 430 is moved down in the receiving unit 100 by its weight, the cover plate 410 connected with the floater 430 by the connecting member 455 is moved up in the receiving unit 100, thereby opening the interceptor port 150.

In contrast, then the floater 430 is moved up in the receiving unit 100 by buoyancy, the cover plate 410 connected with the floater 430 by the connecting member 455 is moved down in the receiving unit 100, thereby closing the interceptor port 150.

The floater 430 may be heavier than the cover plate 410 to achieve this operation.

<Second Embodiment of Opening/Closing Unit>

Figure 5:
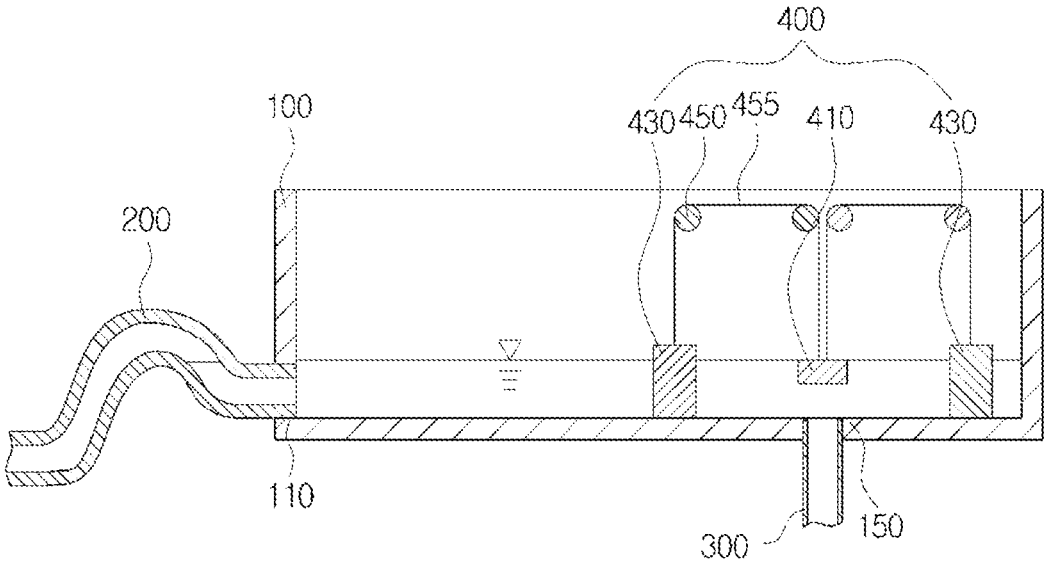
FIG. 5 is a view schematically illustrating an overflow chamber that can discharge rainwater and soil according to another embodiment of the present invention.
Figure 6:
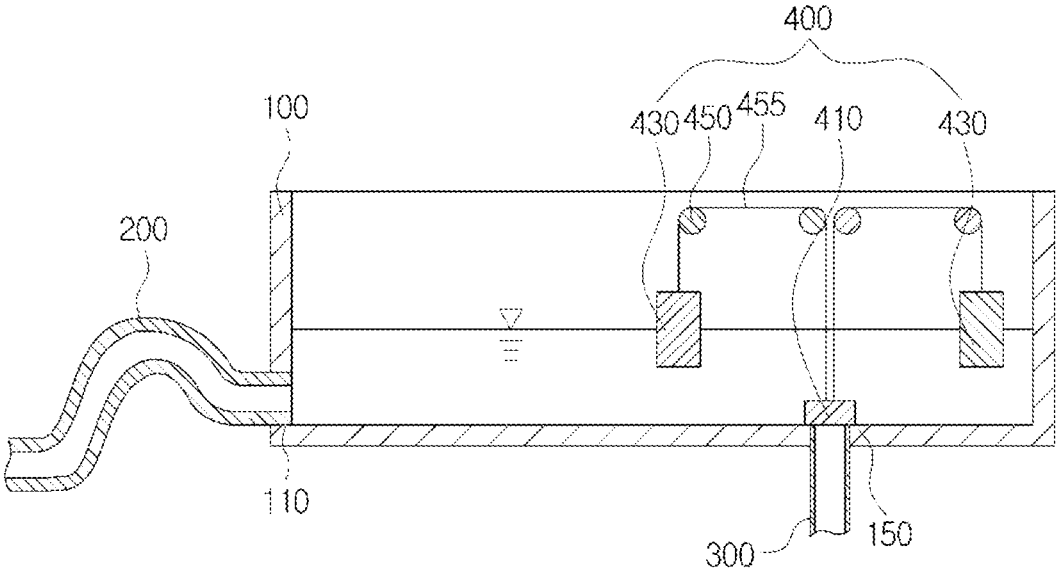
FIG. 6 is a view illustrating an example of operation of the overflow chamber illustrated in FIG. 5.

FIG. 5 is a view schematically illustrating an overflow chamber that can discharge rainwater and soil according to another embodiment of the present invention and FIG. 6 is a view illustrating an example of operation of the overflow chamber illustrated in FIG. 5.

Referring to FIGS. 5 and 6, the opening/closing unit 400 in this embodiment includes a cover plate 410, floaters 430, holding members 450, and connecting members 455.

The cover plate 410 can cover the interceptor port 150, and in this embodiment, the cover plate 410 is a circular plate, but it may be implemented in various shapes such as a rectangular plate as long as it can cover the entire interceptor port 150.

Further, in this embodiment, the interceptor port 150 is formed through the bottom of the receiving unit 100, the cover plate 410 can vertically move with respect to the bottom of the receiving unit 100.

The floaters 430 can be floated on water by buoyancy and can vertically move. In this embodiment, floaters 430 are disposed ahead of and behind the cover plate 410, that is, the floaters 430 are disposed on the front side and the rear side of the receiving unit 100 and can vertically move.

Further, the floaters 430 are connected to the cover plate 410 through the connecting members 455 to be described below.

The connecting members 450 are fixed at predetermined positions in the receiving unit 100 and can hold the connecting members 455 to be described below.

In this embodiment, the holding members 450 are fixed at the uppermost portion of the receiving unit 100 and one holding member is disposed over each of the floaters 430 and two holding members are disposed over the cover plate 410. That is, total four holding members 450 are provided in this embodiment.

The connecting members 455 connect the cover plate 410 and the floaters 450 like a thread and held by the holding members 450 to be freely moved. That is, the connecting member 455 with one end connected to the cover plate 410 is held and changed in direction by the holding member 450 over the cover plate 410 and then held and changed in direction by the holding member 450 over the floater 450, with the other connected to the floater 450.

According to the operation of the opening/closing unit 400 configured as described above, the floater 430 is moved down in the receiving unit 100 by its weight, the cover plate 410 connected with the floater 430 by the connecting member 455 is moved up in the receiving unit 100, thereby opening the interceptor port 150.

In contrast, then the floater 430 is moved up in the receiving unit 100 by buoyancy, the cover plate 410 connected with the floater 430 by the connecting member 455 is moved down in the receiving unit 100, thereby closing the interceptor port 150.

The floaters 430 may be heavier than the cover plate 410 to achieve this operation.

Hereinafter, a method of controlling an overflow chamber that can discharge rainwater and soil which has the configuration according to an embodiment of the present invention is described hereafter.

First, water level increases, as illustrated in FIGS. 3 and 5, when the amount of sewage flowing into the receiving unit 100 in a normal state is a predetermined amount of less or when the amount of inflow water becomes less than the amount of discharge water. As described above, when the water level in the overflow chamber 100 is lower than a predetermined water level, the sewage flowing into the receiving unit 100 is not discharged to the first discharge pipe 200. That is, as in FIGS. 3 and 5, when the water level in the receiving unit is low, the atmospheric pressure applied to the surface of the liquid decreases and the sewage in the receiving unit 100 is not discharged through the first discharge pipe 200.

Further, as in FIGS. 3 and 5, the floater 430 is moved down by their weight, the cover plate 410 open the interceptor port 150, and accordingly, the sewage and rainwater with high concentration in the receiving unit 100 with the interceptor port 150 open is discharged to the second discharge pipe 300 and collected into an interceptor channel.

Next, as illustrated in FIGS. 4 and 6, when it rains and the amount of rainwater flowing into the receiving unit is larger than the discharge amount, the water level in the overflow chamber increases over a predetermined level, so the rainwater and soil flowing into the receiving unit 100 are discharged to the first discharge pipe 200 by the siphon principle. That is, as in FIGS. 4 and 6, when it rains and the water level in the receiving unit 100 is increased by sewage, rainwater, and soil with low concentration flowing into the receiving unit 100, the rainwater and the soil in the receiving unit 100 are discharged to a river through the first discharge pipe 200 by high atmospheric pressure applied to the surface of the liquid.

Further, since the floater 430 is moved up by buoyancy, the cover plate 410 closes the interceptor port 150 and the sewage and soil in the receiving unit 100 are not discharged to the second discharge pipe 300.

Therefore, according to the overflow chamber that can discharge rainwater and soil of the present disclosure, a discharge port connected to one or more separate pipes other than an interceptor channel is disposed in the storage, sewage and rainwater with high concentration flowing into the receiving unit when the water level in the receiving unit is lower than a predetermined level are discharged to a sewerage treatment plant through the interceptor port and the second discharge pipe, and when the water level in the receiving unit is higher than the predetermined level, sewage, rainwater, and soil with low concentration flowing into the receiving unit are discharged to a river through the discharge port and the first discharge pipe by the siphon principle.

Further, according to the overflow chamber that can discharge rainwater and soil of the present disclosure, when a large amount of received object is in the receiving unit (that is, in heavy rain), the interceptor port connected to a sewerage treatment plant is closed, so the received object with relatively low contamination concentration (for example, sewage and rainwater) is prevented from flowing into the sewerage treatment plant and the sewerage treatment cost is reduced.

Further, according to the overflow chamber that can discharge rainwater and soil of the present disclosure, when a small amount of received object is in the receiving unit (that is, it does not rain), the interceptor port connected to a sewerage treatment plant is opened, so received object with relatively high contamination concentration (for example, rainwater and soil) is allowed to flow into the sewerage treatment plant and is prevented from being discharged to a river through the discharge port by the siphon principle, so it is possible to prevent environment contamination due to discharged contaminant substances.

Further, according to the overflow chamber that can discharge rainwater and soil of the present disclosure, the discharge port or the interceptor port can be accurately opened/closed in accordance with the amount of the received objects by the first discharge pipe using the siphon principle and the opening/closing unit using buoyancy, so it is possible to prevent contaminants from being unexpectedly discharged to a river or non-contaminants from flowing into a sewerage treatment plant.

What is claimed is:

1. An overflow chamber that can discharge rainwater and soil, comprising:

a receiving unit having a receiving space;

an interceptor port formed at a side of the receiving unit and selectively opening/closing in accordance with the amount of the rainwater or soil received in the receiving unit;

a discharge port formed at another side of the receiving unit;

a first discharge pipe communicating with the discharge port, wherein said discharge pipe first convexly bends upward relative to the level of and proximal to the discharge port at least one time and then convexly bends downwards relative to an apex of the upwards bend; and an opening/closing unit comprising:

a cover plate covering and selectively opening or closing the interceptor port; and a floater being floated on the rainwater or soil by buoyancy, vertically moving, and connected with the cover plate such that the cover plate moves vertically along a plane parallel with a plane of the side containing the interceptor port, wherein when the floater is moved up in the receiving unit by buoyancy, the cover plate moves vertically to close the interceptor port, and when the floater is moved down in the receiving unit, the cover plate moves vertically to open the interceptor port.

2. The overflow chamber of claim 1, wherein the first discharge pipe connects the discharge port to a river, becomes higher towards the rear portion of the discharge pipe from the inlet of the discharge port and then becomes lower, and determines whether to discharge the rainwater or soil flowing in the receiving unit on the basis of a siphon principle.

3. The overflow chamber of claim 1, further comprising a second discharge pipe connecting the interceptor port and a sewerage treatment plant.

4. The overflow chamber of claim 1, further comprising an opening/closing unit selectively opening/closing the interceptor port in accordance with buoyancy by the rainwater or soil flowing in the receiving unit.

5. The overflow chamber of claim 1, wherein when a level of the rainwater or soil flowing in the receiving unit is lower than a predetermined level, the rainwater or soil is discharged through the interceptor port that is open, not to the first discharge pipe.

6. The overflow chamber of claim 1, wherein when a level of the rainwater or soil flowing in the receiving unit is higher than a predetermined level, the rainwater or soil is discharged only to the first discharge pipe by a siphon principle, and the interceptor port is closed.

7. The overflow chamber of claim 1, wherein the opening/closing unit further includes a holding member fixed at a predetermined position in the receiving unit; and a connecting member held on the holding member to be relatively moved and connecting the cover plate and the floater.

8. The overflow chamber of claim 1, wherein the floater is made of a material heavier than the cover plate.

9. The overflow chamber of claim 5, wherein the rainwater or soil comprises a contamination degree higher than predetermined contamination concentration.

10. The overflow chamber of claim 6, wherein the rainwater or soil comprises a contamination degree lower than predetermined contamination concentration.

11. An overflow chamber that can discharge rainwater and soil, comprising:

a receiving unit having a receiving space;

an interceptor port formed at a bottom of the receiving unit and selectively opening/closing in accordance with the amount of the rainwater or soil received in the receiving unit;

a discharge port formed at a side of the receiving unit;

a first discharge pipe communicating with the discharge port, wherein said discharge pipe first convexly bends upward relative to the level of and proximal to the first discharge pipe at least one time and then convexly bends downwards relative to an apex of the upwards bend; and an opening/closing unit comprising:

a cover plate covering and selectively opening or closing the interceptor port; and at least one floater being floated on the rainwater or soil by buoyancy, vertically moving, and connected with the cover plate such that the cover plate moves vertically along a plane perpendicular with a plane of the bottom of the receiving unit, wherein when the floater is moved up in the receiving unit by buoyancy, the cover plate moves vertically to close the interceptor port, and when the floater is moved down in the receiving unit, the cover plate moves vertically to open the interceptor port.

12. The overflow chamber of claim 11, wherein the opening/closing unit comprises two floaters, each vertically moving, and each independently connected with the cover plate.

* * * * *